United States Patent [19]

Jacobson

[11] Patent Number: 4,698,051

[45] Date of Patent: Oct. 6, 1987

[54] PLASTIC BAG OPENING DEVICE

[76] Inventor: Ralph S. Jacobson, 27970 Le Dunne Avenue, Aldergrove, British Columbia, VOX 1A0, Canada

[21] Appl. No.: 885,150

[22] Filed: Jul. 14, 1986

Related U.S. Application Data

[63] Continuation-in-part of Ser. No. 660,911, Oct. 15, 1984, Pat. No. 4,601,690.

[51] Int. Cl.[4] ..... B31C 3/00

[52] U.S. Cl. ..... 493/309; 294/99.2; 81/487

[58] Field of Search ..... 493/255, 256, 309, 312, 493/313, 473, 963; 53/384, 573; 294/99.2; 271/33; 221/210; 29/239; 81/421, 486, 487; 83/912

[56] References Cited

U.S. PATENT DOCUMENTS

| | | | |
|---|---|---|---|
| D. 138,917 | 9/1944 | Frank | 294/99.2 |
| 391,581 | 10/1888 | Carver | 51/358 |
| 1,889,475 | 11/1932 | Henkel | 294/99.2 |
| 2,505,289 | 4/1950 | Haslett | 294/99.2 |
| 2,541,819 | 2/1951 | Hudson | 294/99.2 |
| 2,610,882 | 9/1952 | Sutlitte | 15/104 A |
| 2,683,274 | 7/1954 | Kappes | 15/106 |
| 3,317,989 | 5/1967 | Cull | 294/99.2 |
| 3,373,457 | 3/1968 | Rouch, Jr. | 15/104 A |
| 3,755,049 | 8/1973 | Leloux | 81/487 |
| 4,033,803 | 7/1977 | Coder | 156/71 |
| 4,073,530 | 2/1978 | Seidler | 294/19.1 |
| 4,330,936 | 5/1982 | Swaith | 294/99.2 |
| 4,357,302 | 11/1982 | Giroir | 294/99.2 |
| 4,601,690 | 7/1986 | Jacobson | 493/309 |

FOREIGN PATENT DOCUMENTS

| | | | |
|---|---|---|---|
| 2642175 | 3/1978 | Fed. Rep. of Germany | 53/384 |

*Primary Examiner*—Frederick R. Schmidt
*Assistant Examiner*—Robert Showalter
*Attorney, Agent, or Firm*—Norman E. Reitz

[57] ABSTRACT

A plastic bag opening device has a flexible U-shaped member which can be slipped over the slit edge of a plastic bag. Adhesive means which are affixed to the inside of the ends of the U-shaped member contact the sides of the plastic bag when the U-shaped member is forced to a closed position. As the U-shaped member is flexed to an open position the sides of the bag adhere to the respective adhesive means and are pulled apart from each other. The ends of the U-shaped member are held apart by inwardly facing protrusions yet a positive clamping action of the adhesive means on the sides of the plastic bag is obtained by a pair of inwardly facing tips.

2 Claims, 10 Drawing Figures

FIG. 7
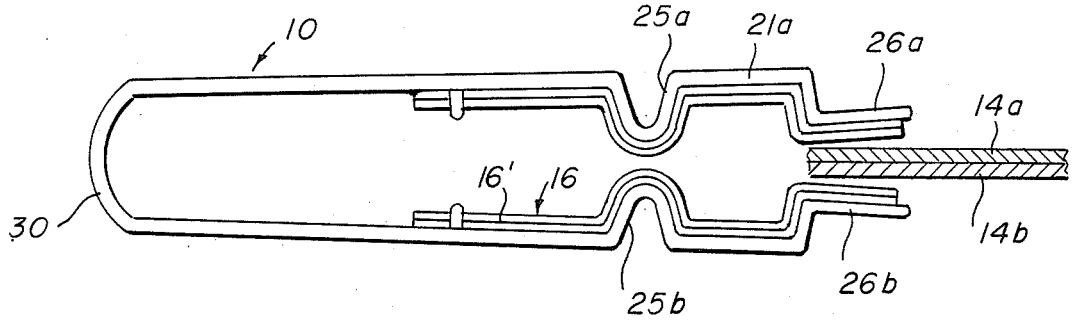
FIG. 8
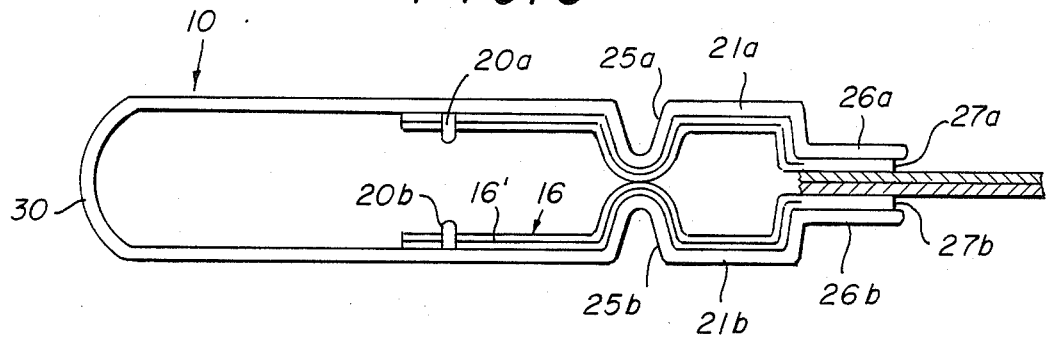
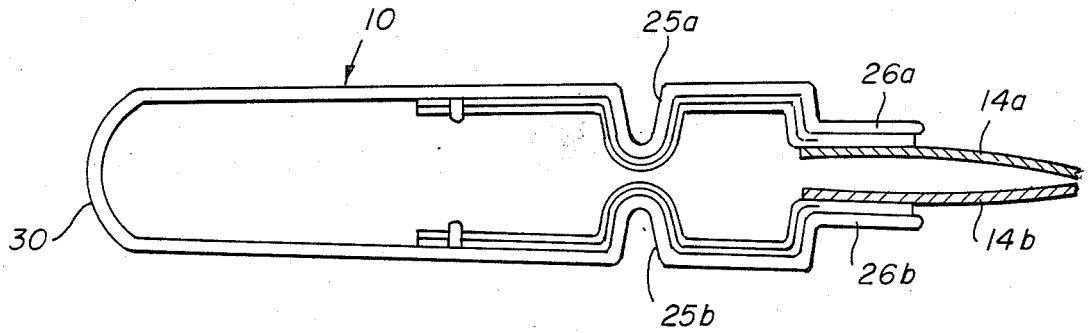
FIG. 9

PLASTIC BAG OPENING DEVICE

This application is a continuation-in-part of Ser. No. 660,911, filed Oct. 15, 1984, "Plastic Bag Opening Device", which will issue July 22, 1986, as U.S. Pat. No. 4,601,690.

This invention relates to a device for opening plastic bags and, more particularly, relates to a device for adhering to and separating the two sides of a plastic bag along the slit edge to expose the interior volume of the bag.

There has been a trend in the packaging industry towards the use of plastic bags. Thus, it is becoming common to carry consumer goods away from retail outlets in plastic bags of very fine gauge. Such bags may be made from polyethylene, polypropelene and other plastic compounds which have high tensile strength in sheet form even for very thin gauges.

Thin plastic bags have a tendency to stick together due to factors such as the attraction of small charges of static electricity and layer-to-layer surface adhesion. As a consequence, particularly for bags that are supplied in continuous rolls such as poly bags used in produce markets, the consumer often has a difficult time opening the bags. The consumer may spend many seconds or minutes struggling with a poly bag in an attempt to separate the sides of the bag along the slit edge. Once the slightest separation occurs the bag may be completely opened. It is thus a key to the convenient use of poly bags to be able to quickly and easily effect the initial separation of the two sides of the bags.

It is therefore an object of the present invention to provide a device for quickly and easily effecting the separation of the two sides of a plastic bag along the slit edge.

It is another object of the present invention to provide a device which adheres to the two sides of a plastic bag along the slit edge and pulls them apart.

It is yet another object of the present invention to provide a device which nondestructively separates the two sides of a plastic bag.

BRIEF DESCRIPTION OF THE DRAWINGS

For a more complete understanding of the present invention reference may be had to the accompanying drawings which are incorporated herein by reference and in which:

FIGS. 2–4 are side views of the device of the present invention illustrating their operation in opening a plastic bag in which;

FIG. 2 shows the open end of the device positioned over the slit edge of a plastic bag;

FIG. 3 shows the device contacting the sides of a plastic bag;

FIG. 4 shows the device with the sides of the plastic bag adhered thereto and separated to expose the interior volume of the bag;

FIG. 7 is a side view of an alternate embodiment positioned over the slit edge of a plastic bag;

FIG. 8 shows the device of FIG. 7 contacting the sides of a plastic bag; and FIG. 9 shows the embodiment of FIGS. 7–8 with the sides of the bag adhered thereto and separated to expose the interior volume of the bag.

SUMMARY OF THE INVENTION

A plastic bag opening device is provided. The device comprises a flexible U-shaped member which can be slipped over the slit edge of a plastic bag. Adhesive means are provided on the inside of the ends of the U-shaped member. As the U-shaped member is flexed to a closed position, the respective adhesive means contact the sides of the plastic bag and the open ends of the U-shaped member are held apart by protrusions on the inside surfaces of the U-shaped member. Then as the U-shaped member is flexed to an open position the sides of the bag are held by the respective adhesive means and pulled apart from each other. Preferably, the adhesive means comprise a layered strip of adhesive tape which rests on the inside surfaces of the open ends of the U-shaped member and on inwardly facing tips at the ends of the U-shaped member.

DESCRIPTION OF THE PREFERRED EMBODIMENT

In the era of high labor costs the consumer is increasingly involved with carrying out tasks that formerly were performed by clerks or service persons. Thus, he pumps his own gasoline, makes repairs on his own home and participates in the task of bagging his own groceries. In virtually all grocery super markets the shopper will select his own fruits and vegetables and place them into plastic bags. He may also be required to scoop out and bag such bulk items as granola, beans, legumes and the like. He is likely to have to tear the bag off a continuous roll placed near the bin where the particular food product is displayed. It is highly desirable that the plastic bag be torn off the roll, opened, filled and sealed with minimum effort and maximum reliability. Unfortunately, the thin gauge bags in widespread use often stick together and are difficult to open.

Figure 1:
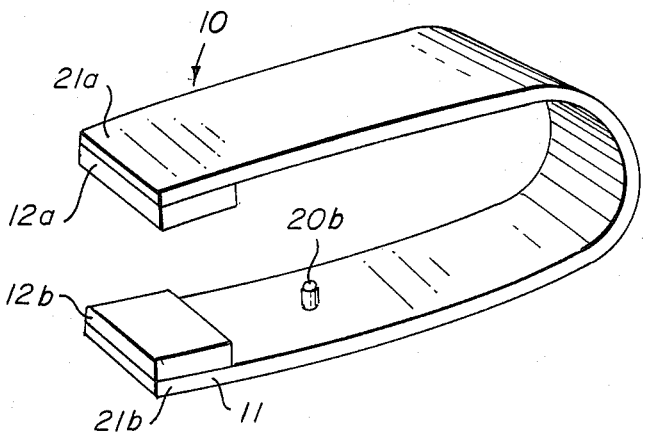
FIG. 1 is a perspective view of the device of the present invention without adhesive means in place.

The device of the present invention is provided to facilitate the opening of thin gauge plastic bags. The device 10 is shown in perspective view in FIG. 1. It is comprised of a resilient U-shaped member 11 fabricated from plastic, stainless steel or like materials which are bendable and resilient. U-shaped member 11 is formed so that in its unflexed position the ends 21*a* and 21*b* are not in contact and have sufficient opening between themselves to allow the insertion of the slit edge of a plastic bag. Deformable pads 12*a* and 12*b* are attached, respectively, to the inside of the ends 21*a* and 21*b* of U-shaped member 11. As the ends 21*a* and 21*b* are flexed inwardly to contact a plastic bag the pads deform so as to present a flat surface to the sides of the plastic bag, as shown particularly in FIG. 3. Finally, a layered adhesive strip 16, shown in place in FIGS. 2–4, is fitted over nubin 20 and stretched onto pads 12.

Figure 2:
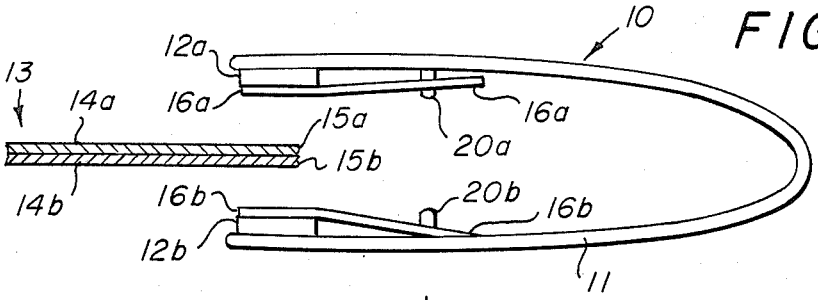
Figure 3:
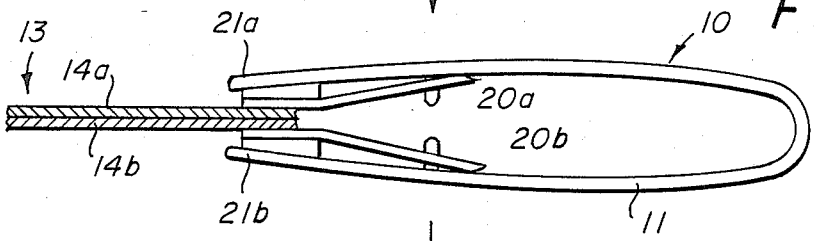
Figure 4:
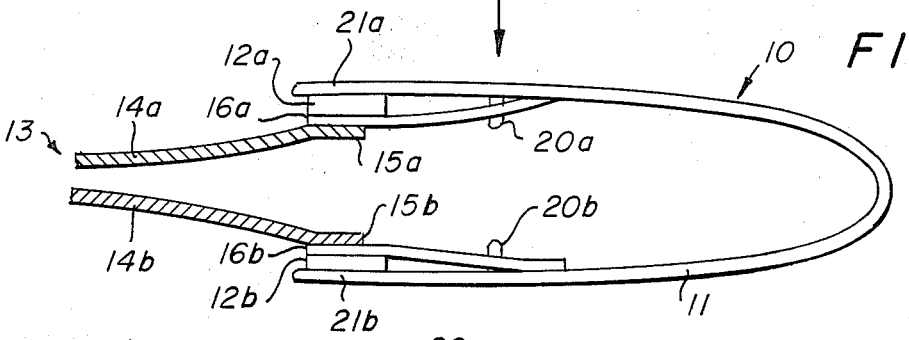

The use of the device of the present invention is shown particularly in FIGS. 2–4. A plastic bag 13 having sides 14*a* and 14*b* is shown with the ends 15*a* and 15*b* of the slit edge being placed in between the ends 21*a* and 21*b* of the device. The sides 14*a* and 14*b* are shown to be in intimate contact. In practice since the thickness of sides 14*a* and 14*b* is so small it is very difficult to separate the ends 15*a* and 15*b* at the slit edge by trying to wedge an opening between them. In FIG. 3 the ends 21*a* and 21*b* of U-shaped member 11 are shown to be closed together so that the surfaces of tape 16*a* and 16*b* make contact, respectively, with sides 14*a* and 14*b* of bag 13. Ends 21*a* and 21*b* are closed together, for example, by the thumb and forefinger of a human hand. When the force of closure is removed, U-shaped member 11 returns to its initial position. Thus, the position of the U-shaped member 11 in FIG. 4 is the same as the position in FIG. 2. However, the ends 15*a* and 15*b* of bag 13 are now adhered, respectively, to layered tape 16*a* and 16*b*. Consequently, sides 14*a* and 14*b* are pulled apart. The operator can wedge his finger in between sides 14*a* and 14*b* and keep them apart so the bag may be filled.

Figure 5:
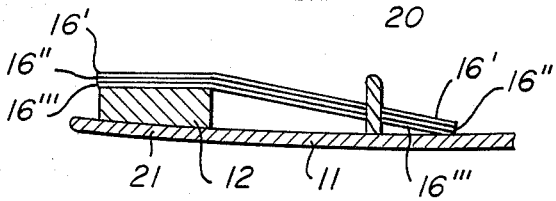
FIG. 5 is an expanded side cross sectional view of the forward end of a portion of the device of the present invention.

The device of the present invention utilizes a layered tape 16 so that a fresh adhesive can be exposed for use at any time. This is shown particularly in FIG. 5 which is a side cross sectional view of one of the ends 21 of the U-shaped member 11. The tape 16 is shown to be composed of layers 16', 16'' . . . 16$^n$. When the top layer 16' loses its adhesive or becomes contaminated it may be removed by peeling it off, thereby exposing the fresh adhesive surface 16'' and so on.

Figure 5A:
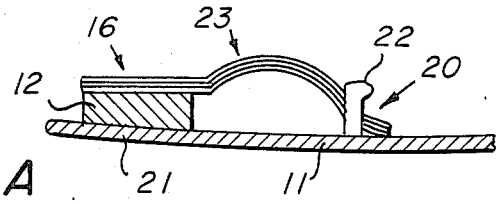
FIG. 5*a* illustrates alternate embodiment for the nubbin portion of the plastic bag opening device.
Figure 6:
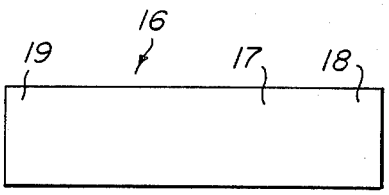
FIG. 6 is a plan view of the strip of adhesive means used with the device of the present invention.

It is only necessary for the bottom tape, 16'', to have adhesive on both sides since it alone must adhere to the associated deformable pad. The remaining adhesive tapes, 16', 1641 . . . 16$^{n-1}$ need only have an adhesive coating on the upper side in the region 19 to make adhering contact with the side of the thin gauge plastic bag. Preferably, region 18 of tape 16 will have no adhesive. As shown in FIG. 6 the hole 17 is sized and positioned to fit over nubbin 20. In a preferred embodiment, shown in FIG. 5*a*, the upper tip of nubbin 20 has a rearward projection 22 which serves to prevent the region 18 of layered tape 16 from inadvertently slipping off nubin 20. The size of hole 17 can be selected to be large enough to slip over projection 22 and then onto nubbin 20 but not so large as to allow tape 61 to be slipped in a continuous upward motion off nubin 20. Prefereably, the length of layered tape 16 is great enough to permit a slack region 23 so that the top layer of tape can be pulled off the remaining stock by maneuvering the hole 17 in the top layer to the tip of rearward projection 22 so that the entire top layer may be removed.

An alternate embodiment of the plastic bag opening device of the present invention is shown in FIGS. 7–9. Here, the deformable pads 12*a* and 12*b* (FIGS. 2–4) are eliminated and inwardly facing tips 26*a* and 26*b* are utilized to provide opposing surfaces 27*a* and 27*b* for clamping against the sides 14*a* and 14*b*, respectively, of the plastic bag 13. In addition, the protrusions 25*a* and 25*b* are provided on the ends 21*a* and 21*b*, respectively, of the device. With this embodiment the opposing surfaces 27*a* and 27*b* provide a positive clamping action whereby the working layer 16' of the tape 16 is pressed against the sides 14*a* and 14*b* of the plastic bag along substantially the entire extent of the length of the tips 26*a* and 26*b*.

In operation, the plastic bag 13 is slipped in between the open ends of the device 10, as shown in FIG. 7. The inwardly facing tips 26*a* and 26*b* are separated sufficiently by the natural spring action of the curved end 30 to stand away from the sides 14*a* and 14*b* of the plastic bag 13. Thus, no adhesive contact occurs between the bag 13 and the working layer 16' of the layered adhesive tape 16 during insertion. Then the ends 21*a* and 21*b* are closed together, for example, by the thumb and forefinger of a human hand. The tips 26*a* and 26*b* clamp the working surface 16' of the layered adhesive 16 against the sides 14*a* and 14*b*. Preferably, the stop position coincides with the position at which the protrusions 25*a* and 25*b* come into contact, as shown in FIG. 8. When the ends 21*a* and 21*b* are released they spring apart and the sides 14*a* and 14*b* of the plastic bag are pulled apart. The protrusions 25*a* and 25*b* prevent the device from being warped or broken by overflexing. The inward facing tips 26*a* and 26*b* permit substantial contact between the working surface 16' of the multilayered adhesive strip 16 and the sides 14*a* and 14*b* of the plastic bag without the need for deformable pads.

I claim:

1. A device for opening the ends of thin gauge plastic bags, comprising:

a resilient U-shaped member being biased to a normally open position which allows the slit edge of a plastic bag to be positioned between the open ends thereof;

an inwardly facing tip appended to each of said ends;

a pair of nubbins affixed, respectively, to the inside surfaces of said ends of said resilient U-shaped member inboard of said inwardly facing tips;

a multilayered adhesive strip stretched over the inside surfaces of each of said inwardly facing tips and onto said nubbins, at least a portion of the exposed surface of each layer having an adhesive substance thereon to make adhesive contact with respective ones of said ends of said thin gauge plastic bag to allow said bag to be opened as said U-shaped member moves to its normally open position; and a pair of inwardly facing protrusions affixed to the inner surfaces of each of said ends of said device, said protrusions contacting each other when said inwardly facing tips and multilayered strips clamp onto said plastic bag.

2. A device for opening plastic bags in accordance with claim 1 wherein said protrusions are placed, respectively, between said inwardly facing tips and said nubbins.

* * * * *

UNITED STATES PATENT AND TRADEMARK OFFICE

CERTIFICATE OF CORRECTION

PATENT NO. : 4,698,051

DATED : October 6, 1987

INVENTOR(S) : Ralph S. Jacobson

It is certified that error appears in the above-identified patent and that said Letters Patent is hereby corrected as shown below:

The term of this patent subsequent to July 22, 2003, has been disclaimed.

Signed and Sealed this

Thirteenth Day of December, 1988

*Attest:*

DONALD J. QUIGG

*Attesting Officer*

*Commissioner of Patents and Trademarks*